US005375837A

United States Patent [19]

Moreau

[11] Patent Number: 5,375,837

[45] Date of Patent: Dec. 27, 1994

[54] FOLDING TABLE TENNIS APPARATUS

[75] Inventor: Philip M. Moreau, Carmel, Calif.

[73] Assignee: SDS Honeycomb, Inc., Carmel, Calif.

[21] Appl. No.: 37,299

[22] Filed: Mar. 26, 1993

[51] Int. Cl.[5] ..... A63B 39/00

[52] U.S. Cl. ..... 273/30; 108/79

[58] Field of Search ..... 273/30; 108/63, 64, 108/65, 67, 99, 79, 110–114

[56] References Cited

U.S. PATENT DOCUMENTS

| | | | |
|---|---|---|---|
| 2,665,908 | 1/1954 | Gray | 273/30 |
| 2,731,316 | 1/1956 | Cohen | 108/114 |
| 2,769,636 | 11/1956 | Firestone | 273/30 |
| 3,323,797 | 6/1967 | Horton | 273/3 R |
| 3,468,536 | 9/1969 | Minshull | 273/30 |
| 3,489,410 | 1/1970 | Stillman | 273/9 |
| 3,760,456 | 9/1973 | Mark | 273/30 |
| 3,823,938 | 7/1974 | Unno | 273/30 |
| 3,830,495 | 8/1974 | Hill | 273/30 |
| 3,866,913 | 2/1975 | Zimmers | 273/30 |
| 4,503,781 | 3/1985 | Nilsson | 108/114 |
| 4,942,829 | 7/1990 | Harris | 108/65 |

FOREIGN PATENT DOCUMENTS

| | | | |
|---|---|---|---|
| 568741 | 1/1933 | Germany | 273/30 |
| 0215706 | 3/1987 | United Kingdom | 273/30 |

*Primary Examiner*—Theatrice Brown

*Attorney, Agent, or Firm*—Flehr, Hohbach, Test, Albritton & Herbert

[57] ABSTRACT

Table tennis apparatus is disclosed which incorporates a pair of tabletop panel assemblies each of which comprises a pair of subpanels which fold together into a light and compact unit for storage or shipping. The subpanels include support structures which carry a planar layer formed of a flexible material which provides the playing surface. The planar layer bridges across a folding butt joint which separates the subpanels without creating any objectionable undulations or seam along the butt joint when the panels are unfolded into the playing configuration. The apparatus is adapted for converting to a single player configuration in which one of the tabletop panel assemblies is mounted upright to serve as a backstop along a side of the remaining horizontally positioned panel assembly. The components are releasably locked in the different configurations by splines which interfit into keyway recesses formed in the perimeters of the subpanels. The apparatus can be easily assembled and disassembled without the requirement for tools or hardware.

21 Claims, 6 Drawing Sheets

FOLDING TABLE TENNIS APPARATUS

BACKGROUND OF THE INVENTION

1. Field of the Invention

This invention relates generally to the game of table tennis, also known as Ping Pong®. More particularly, the invention relates to table tennis apparatus which is lightweight, foldable and readily adapted for portability.

2. Description of the Prior Art

In the game of table tennis the conventional tables provide tabletop panels made of rigid and strong materials to provide a uniformly flat playing surface. Panels made of plywood or synthetic plastic materials have been used. These conventional tabletop panels are relatively large and heavy and are not readily adaptable for portability, such as shipping through a parcel delivery service. Many of the conventional tables must also be assembled through the use of hardware such as bolts or other fasteners. Assembly and disassembly of tables of this type involves considerable time and effort. The need has therefore been recognized for table tennis apparatus having tabletop panels which are foldable and which can be readily collapsed into lightweight units of compact size for portability, and which further can be reassembled to provide a uniformly flat and unbroken playing surface.

OBJECTS AND SUMMARY OF THE INVENTION

It is a general object of the present invention to provide table tennis apparatus which can be collapsed into a compact size for portability.

Another object is to provide table tennis apparatus of the type described having tabletop panels which can be folded into a compact size for portability and in which the panels can be unfolded to provide a uniformly flat and unbroken playing surface.

Another object is to provide table tennis apparatus of the type described having tabletop panels which fold along a hinge line for storage or portability, and which unfold into a uniformly flat playing surface without objectionable undulations or seams along the hinge line.

Another object is to provide table tennis apparatus of the type described which can be safely and readily assembled without the requirement for tools or hardware.

Another object is to provide table tennis apparatus of the type described having components which can be speedily set up for play and knocked down for storage or transport.

Another object is to provide table tennis apparatus of the type described which can be readily converted back and forth between double play and single play mode configurations.

The foregoing and additional objects and features of the invention will appear from the following specification in which the several embodiments have been set forth in detail in conjunction with the accompanying drawings.

DESCRIPTION OF THE PREFERRED EMBODIMENTS

The drawings illustrate generally at 20 table tennis apparatus in accordance with a preferred embodiment of the invention. In FIGS. 1–4 the apparatus is shown assembled for use in the double play mode, and in FIGS. 14–15 the apparatus is shown assembled for use in a single play mode.

Figure 1:
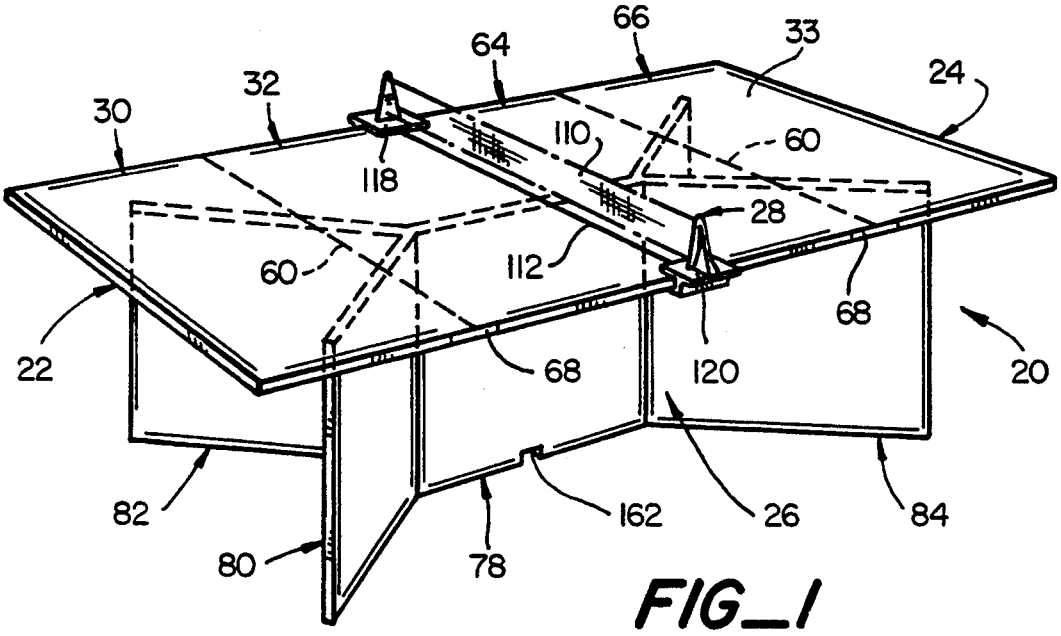
FIG. 1 is a perspective view of table tennis apparatus in accordance with one preferred embodiment of the invention.
Figure 2:
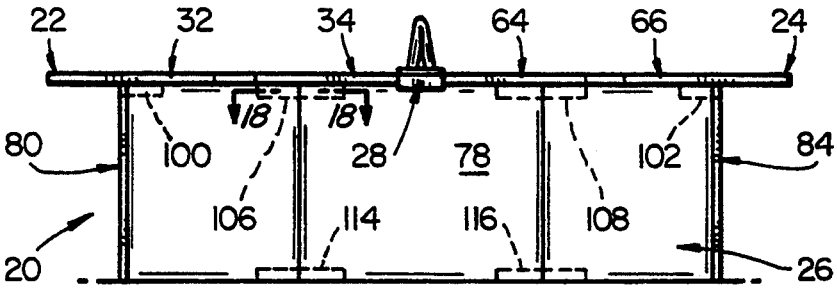
FIG. 2 is a side elevational view of the apparatus of FIG. 1.
Figure 3:
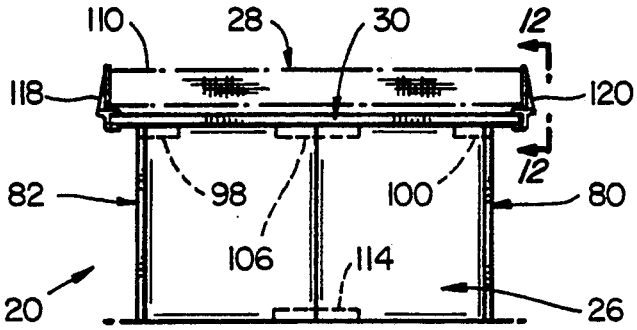
FIG. 3 is an end elevational view of the apparatus of FIG. 1.

Table tennis apparatus 20 is comprised of a pair of tabletop panel assemblies 22, 24, leg panel assembly 26 and net assembly 28. In FIGS. 1–3 the leg panel assembly is shown supporting both tabletop panel assemblies in horizontal orientation and with the net assembly in place.

Figure 5:
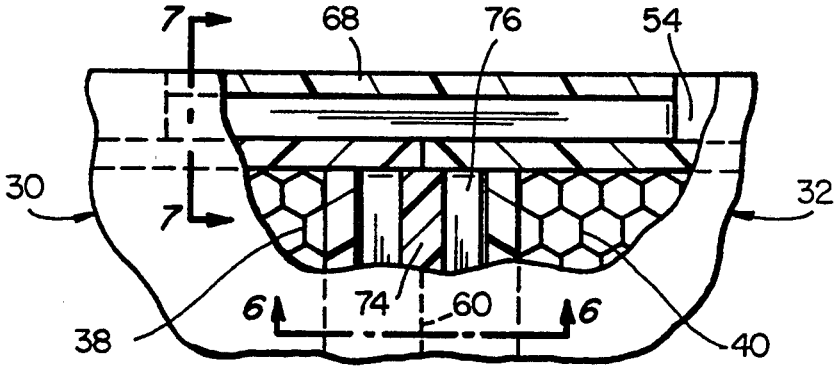
FIG. 5 is an enlarged, partially cut away, view of a portion of the butt joint of two subpanels of the tabletop as indicated by the line 5—5 of FIG. 4.
Figure 6:
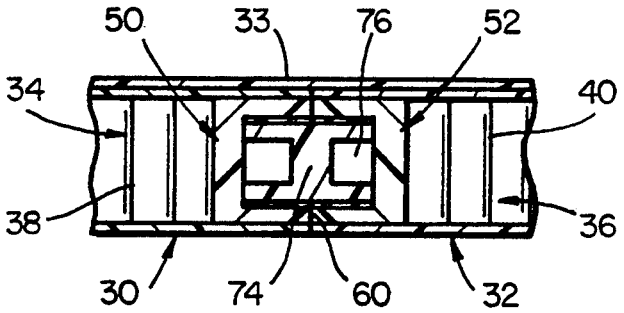
FIG. 6 is a cross sectional view of the butt joint taken along the line 6—6 of FIG. 5.
Figure 7:
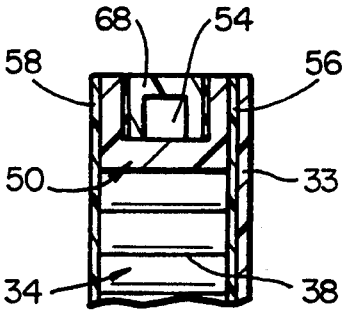
FIG. 7 is a cross sectional view taken along the line 7—7 of FIG. 5 showing a spline locked into a keyway recess in the end perimeter edges of the subpanels.

Both tabletop panel assemblies are similar in construction, and it will suffice to explain in detail the structure of assembly 22. Assembly 22 is comprised of a set of first and second subpanels 30, 32 which are mounted below a planar layer 33 that provides a uniform playing surface. The subpanels 30, 32 are comprised of respective support structures 34, 36 which are sufficiently rigid and strong to resist bending moments, and also to provide a stable playing surface, when mounted for play above the leg panel assembly. In the invention, the support structures 34, 36 are comprised of respective cores formed of a honeycomb matrix of cells 38, 40 with their long axes oriented perpendicular to planar layer 33, as best illustrated in FIGS. 5–7. Preferably the walls of the honeycomb cells are formed of a sheet-like material such as sheets of Kraft paper which are preshaped and glued together.

Subpanel 30 is typical and is bounded by a pair of opposite side perimeter edges 42, 44 together with a pair of opposite end perimeter edges 46, 48. Each perimeter edge mounts along its length an elongate "U"-shaped locking member 50, 52, which preferably is formed of a suitable UV treated hard polyvinyl chloride (PVC). Each locking member forms a concaval keyway recess 54 facing outwardly from the respective perimeter edge. Each subpanel further includes top and bottom thin layers or skins 56, 58 of a suitable synthetic polymer material such UV treated styrene. The top skin 56 is secured by a suitable adhesive to the top ends of the honeycomb matrix and also to the top surfaces of the four locking members 50 about the perimeter of the subpanel. Bottom skin 58 is similarly secured by a suitable adhesive to the bottom edges of the honeycomb matrix and also to the bottom surfaces of the four locking members.

Each subpanel has a width of 60" and length in the long direction of the playing surface of 27". The two subpanels 30, 32 are positioned together with their end perimeter edges defining a folding butt joint 60. With both subpanels aligned in coplanar relationship, the overall dimension of the resulting tabletop panel assembly 22 in the long direction of the playing surface is 54" and with a width of 60". With the two tabletop panel assemblies mounted together in abutting relationship as shown in FIG. 1, the overall length of the playing surface is the regulation 108".

Figure 10:
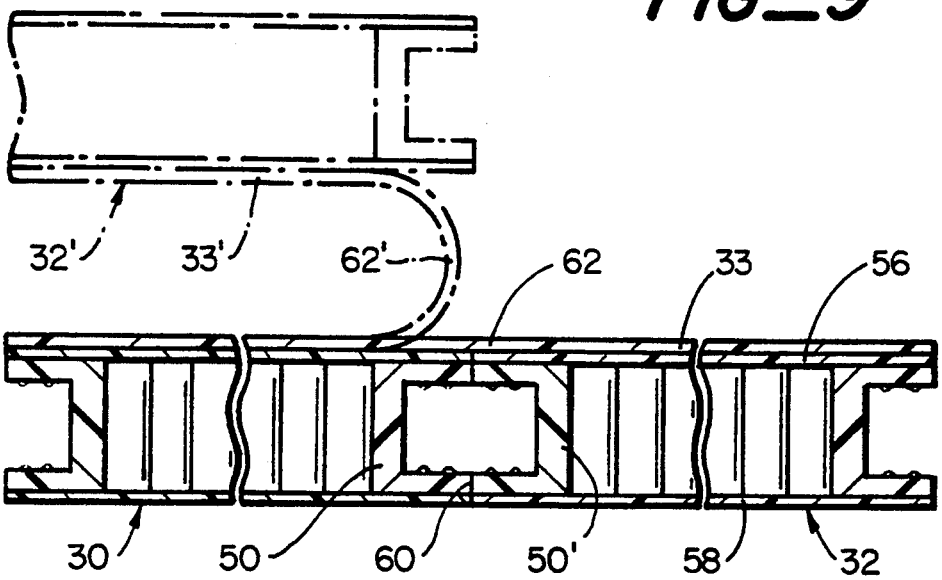
FIG. 10 is a cross sectional view similar to FIG. 6 with the locking spline removed and showing in phantom view the folded position of the subpanels for one of the tabletop panels.

Planar layer 33 is formed of a soft flexible PVC material having a thickness on the order of 20 mil. The length and width of each planar layer is commensurate with the 54" length and 60" width of the respective tabletop panel assembly. The bottom surface of the planar layer is secured by a suitable adhesive to the top surfaces of the UV treated styrene skins 56 of the top sides of the subpanels. As best shown in FIG. 10, a middle strip 62 of planar layer 33 having a width approximately equal to the combined widths of the two locking members 50, 50' along the adjacent end perimeter edges of the subpanels is not bonded to the top skin 56. This unbonded strip 62 provides a joining portion of the planar layer which bridges across the folding butt joint 60 formed between the subpanels. Planar layer 33 is sufficiently flexible to enable the subpanels to pivot about the butt joint between the open position shown in solid line of FIG. 10 and the folded position shown in broken line of that figure. In the open position, planar layer 33 is uniformly flat across the entire surface of the tabletop panel assembly and does not create any undulation or seam above the butt joint. The radius of curvature of the joining portion shown in FIG. 10 is on the order of $\frac{3}{4}$" so that the resulting gap between the facing sides of layer 33 in the folded position is approximately $1\frac{1}{2}$".

Figure 11:
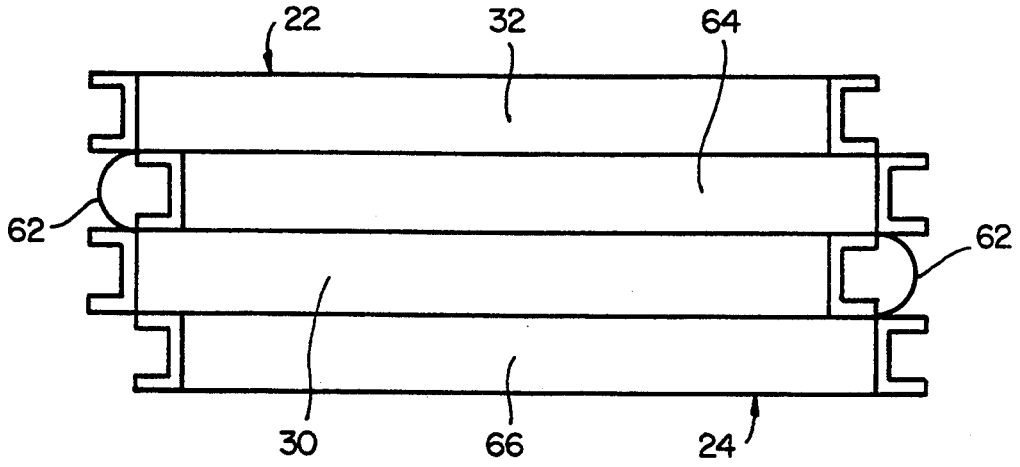
FIG. 11 is a side elevational view to a reduced scale showing the folded subpanels of two tabletop panels interleaved together and forming a compact unit for portability.

FIG. 11 illustrates the manner in which both table panel assemblies 22 and 24, after their respective subpanels are collapsed into their folding positions, are placed together to form a unit of compact size and shape which is acceptable for shipping by parcel delivery services. One subpanel 30 of panel assembly 22 is inserted into the gap formed between the folded subpanels 64, 66 of the other panel assembly 24, while subpanel 64 is inserted into the gap formed between folded subpanels 30 and 32 of panel assembly 22.

Figure 8:
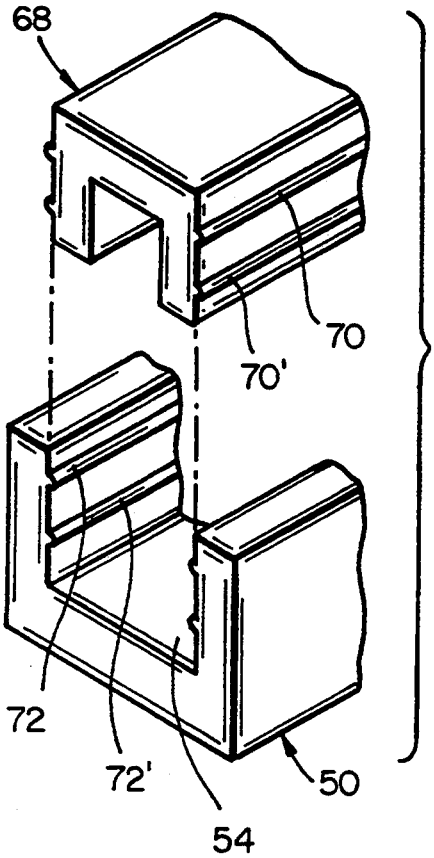
FIG. 8 is a perspective to a reduced scale showing details of the locking teeth for the spline and keyway recess shown in FIG. 7.

Lock means is provided for releasably locking the subpanels of each panel assembly in their open positions. The lock means includes a "U"-shaped spline 68, which is shown in detail in FIGS. 5, 7 and 8. As best shown in FIG. 8, the opposite sidewalls of the spline are formed with outwardly projecting, elongate parallel ribs or teeth 70, 70' which project a short distance above the sidewall surfaces. The cross section of spline 68 is shaped commensurate with the keyway recesses 54 formed in the locking members 50 along the side perimeter edges of the subpanels. On the inside surfaces of the recesses elongate parallel ribs or teeth 72, 72' are formed commensurate in size and shape with the teeth on spline 68. Spline 68 is formed of a UV treated hard PVC material which permits the teeth to elastically deform when the spline is pushed into the locking member recess in the manner shown in FIG. 8. As the teeth of spline deform they ride over the teeth of the recess so as to releasably lock the spline within the locking member. The spline is released by manually pulling it out with sufficient force to disengage the teeth. When engaged with the locking member, the spline holds the perimeter edges of the subpanel in alignment. At the opposite side of each subpanel a similar spline is provided for locking the opposite perimeter edges in alignment.

The locking means further includes an "H"-shaped spline 74, best shown in FIG. 6. Spline 74 is comprised of a UV treated PVC material and is formed on its upper and lower surfaces with a plurality of elongate parallel ridges or teeth which are sized and shaped commensurate with the teeth formed in the recesses of the locking members 52 on the adjacent end perimeter edges of the two subpanels. With the subpanels folded to their open position shown in FIG. 6, the facing recesses of the two locking members cooperate to form an elongate cavity 76 extending lengthwise of butt joint 60. The "H"-shaped spline is inserted into this cavity from the side of the tabletop panel. The "U"-shaped spline is then inserted and locked as described above. At the opposite side of the tabletop panel a similar "H"-shaped spline 74 is inserted into the other end of the cavity formed between the recesses, and an additional "U"-shaped spline 68 is then locked into place on that side.

Figure 9:
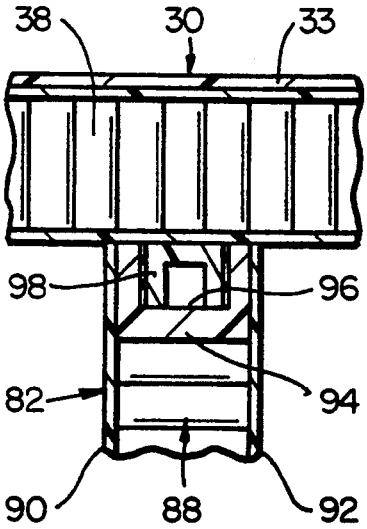
FIG. 9 is a fragmentary cross sectional view to an enlarged scale taken along the lines 9—9 of FIG. 4 showing details of the arrangement for mounting the subpanels above the end and center leg panels.

Leg panel assembly 26 is comprised of a center leg panel 78, a first pair of end leg panels 80, 82 and a second pair of end leg panels 84, 86. The leg panel 82 shown in FIG. 9 is typical and is comprised of a support structure 88 of honeycomb core construction on the sides of which thin layers or skins 90, 92 are attached. Preferably the honeycomb core is comprised of the preformed Kraft paper, and the skin is of the UV treated styrene material, as described above for the subpanels 30 and 32. The four perimeter edges of each of the leg panels mount "U"-shaped locking members 94, as illustrated at the top perimeter edge of end leg panel 82 shown in FIG. 9. Concaval keyway recesses 96 in the locking members are formed with elongate parallel teeth in the manner described above for the locking members of the subpanels.

Figure 4:
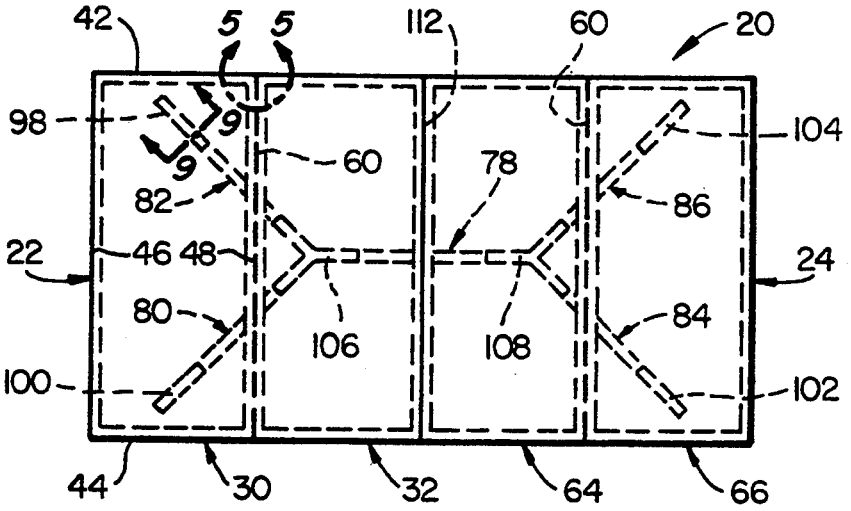
FIG. 4 is a top plan view of the apparatus of FIG. 1.
Figure 18:
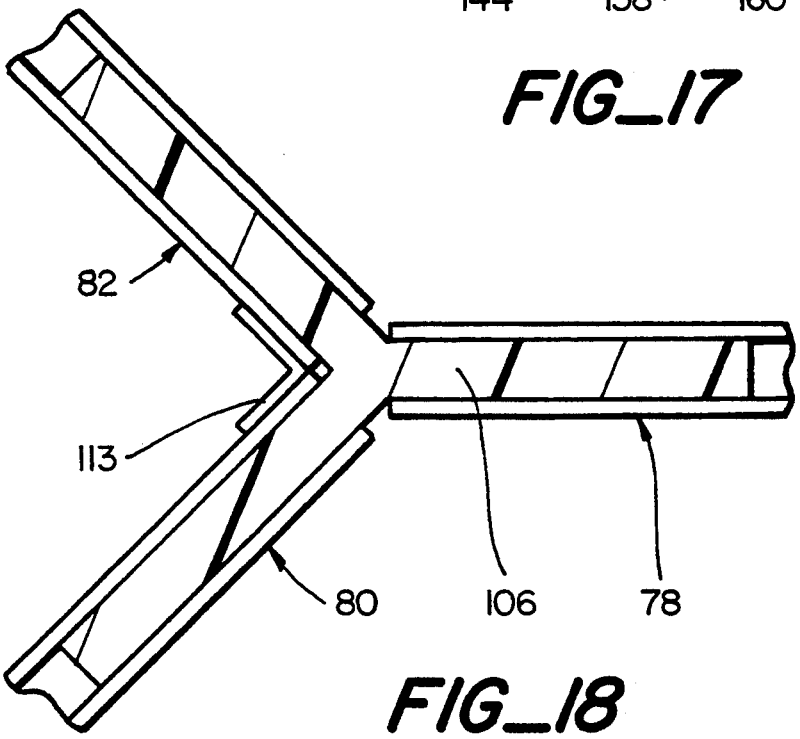
FIG. 18 is a cross sectional view to an enlarged scale taken along the line 18—18 of FIG. 2 showing one of the "Y" floor supports for mounting the center and two end leg panels.

Attachment means is provided for releasably attaching the top perimeter edges of the end and center leg panels to the lower surfaces of the tabletop subpanels. The attachment means includes four elongate splines 98–104, each of which is secured as by adhesive to the lower surface of the subpanels at a position in alignment with the top perimeter edge of a respective one of the end leg panels 80–86, as shown in FIG. 4. The attachment means further includes a pair of "Y"-shaped splines 106, 108 which are attached as by adhesive below the subpanels in alignment with the upper perimeter edges of the junctures of one side of the center leg panel and the apex formed by two of the end leg panels, also as shown in FIG. 4. The elongate splines 98–104 and the "Y"-shaped splines 106, 108 are each formed with a downwardly facing "U"-shaped cross section in the manner shown for the typical spline 98 in FIG. 9. The outer sides of the two arms of the splines are formed with elongate parallel teeth similar to the teeth described above for the splines used to lock the subpanels together. Both the elongate and "Y"-shaped splines are sized and shaped commensurate with the recesses 96 in the locking members so that when the splines are inserted into the recesses the teeth snap into locking relationship. When snapped in place in this manner, center panel 78 is aligned along the centerline of apparatus 10 orthogonal with the position of net 110 which is above the separable butt joint 112 formed between the two tabletop panel assemblies 22, 24. As best shown in FIG. 18, each pair of end leg panels 80, 82 are positioned so that they diverge outwardly in a "V" configuration. A suitable fabric hinge 112 is glued along the adjacent margins of panels 80, 82 to provide a flexible hinge. The outer ends of the end leg panels provide support underneath the corners of the tabletop.

Floor support means is provided for anchoring the bottom perimeter edges of the center and end leg panels over the floor or other supporting surface. This support means comprises a pair of "Y"-shaped spines 114. 116 (FIG. 2) which are sized and shaped similar to the "Y" spines 106, 108 attached beneath the subpanels. The legs of the "Y" spines 114, 116 are sized and shaped commensurate with the keyway recesses formed in the bottom perimeter edges of the leg panels. Locking teeth formed on these "Y" spines and within the keyway recess intergage in the manner described above for releasably holding the lower portions of the leg panels together in the configuration illustrated in FIG. 4. The floor support "Y" spines 106, 108 preferably are movable over the floor for moving the table, or for converting to the single player configuration as described in connection with FIGS. 14–17.

Figure 12:
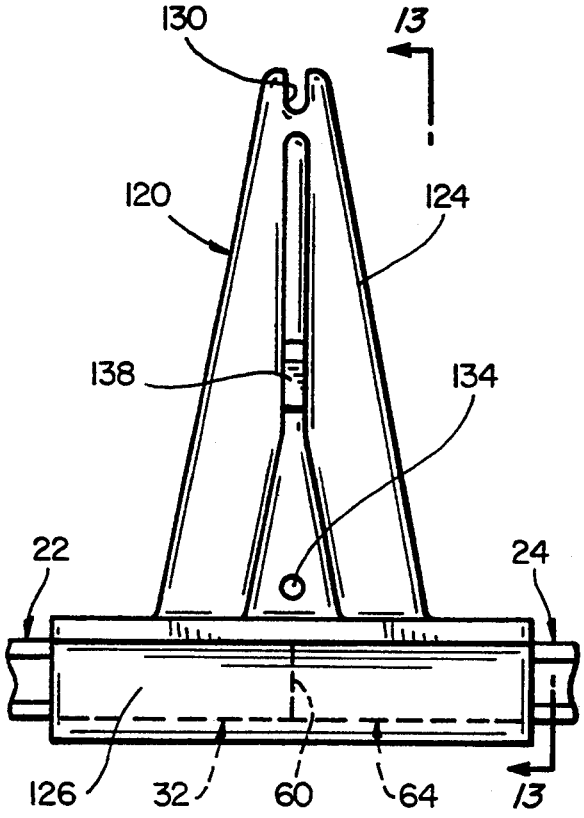
FIG. 12 is a plan elevational view to an enlarged scale of one net post taken along the line 12—12 of FIG. 3.
Figure 13:
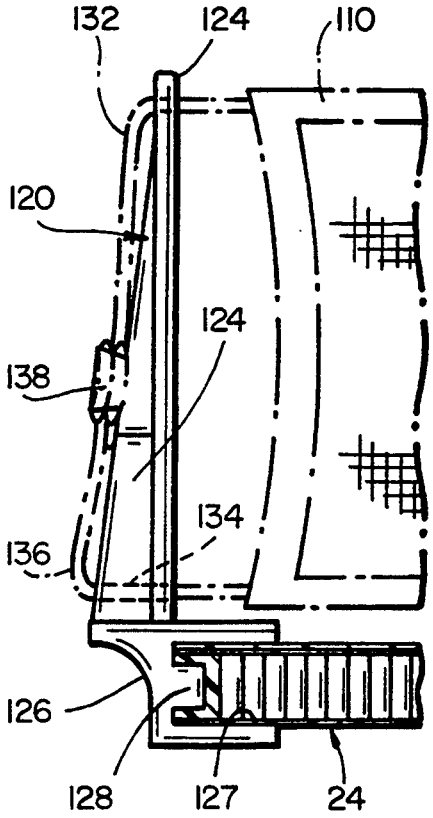
FIG. 13 is a sectional view taken along the line 13—13 of FIG. 12.

Net assembly 28 comprises a pair of net posts 118, 120 for supporting net 110 across the center dividing line between the tabletop panel assemblies. The net post 120 is typical and is shown in detail in FIGS. 12 and 13. It includes a bracket 124 extending upright from a base member 126. Base member 126 is formed with an elongate channel 127 having a vertical height commensurate with the vertical width of the subpanels. A male spline 128 formed integral with the base member projects into the channel, and this spline is sized and shaped commensurate with the keyway recess in the locking members on the side perimeter edges of the subpanels. The top and bottom sides of spline 128 are formed with teeth sized to interlock with the teeth formed in the keyway recess. The side perimeter edges of the subpanels which abut along the center dividing line below the net are releasably held together by pushing base member 126 inwardly so that the male spline releasably locks with the keyway channels.

Net post bracket 124 is formed at its upper end with a slot 130 through which the upper net string 132 is reeved. An opening 134 is formed at the lower end of the bracket for guiding the lower net string 136. A hook 138 on the outer edge of the bracket is provided for tying up the net strings so that the net can be drawn taut.

FIGS. 14–17 illustrate table tennis apparatus 20 converted to its single play configuration. For this configuration, the additional elements required include a pair of "T"-shaped splines 140, 142 and a pair of triangular corner locks 144, 146.

Figure 16:
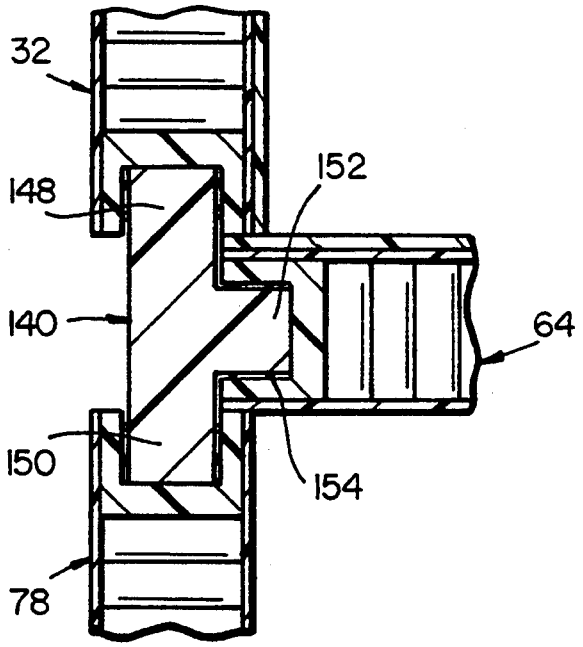
FIG. 16 is cross sectional view to an enlarged scale taken along the lines 16—16 of FIG. 14 showing details of the splines which secure components of the apparatus together.

Spline 140 is typical and is shown in detail in FIG. 16. It is comprised of an elongate body formed with upper and lower male splines 148, 150 and an outwardly extending center male spline 152. Each of the three male splines are sized and shaped commensurate with the keyway recesses in the peripheral edges of the respective table subpanels 32, 64 and center leg panel 78. The sidewalls of each of the splines are formed with elongate parallel teeth 154 which are adapted to interlock with the teeth formed internally within the keyway recesses.

Figure 17:
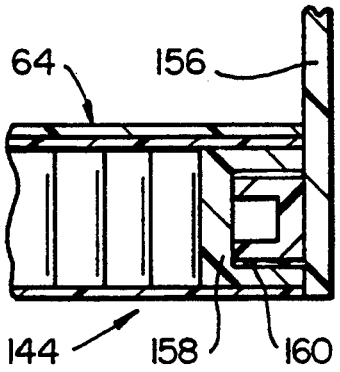
FIG. 17 is a cross sectional view to an enlarged scale taken along the line 17—17 of FIG. 14.

Triangular corner lock 144 is typical and is comprised of a generally triangular shaped flat plate 156 having a vertical edge and horizontal edge. Attached to the inside surface along the horizontal edge of the plate is an elongate "U"-shaped horizontal spline 158, and attached to the plate's inside surface along the vertical edge is an elongate "U"-shaped vertical spline (not shown). As best shown in FIG. 17, the horizontal spline 158 is sized and shaped commensurate with the keyway recess in the side perimeter edge of the inner subpanel 64 of horizontal panel assembly 24. The vertical spline is similarly sized and shaped commensurate with the keyway recess in the side perimeter edge of lowermost subpanel 32 of vertical panel assembly 22. The sidewalls of both of the horizontal and vertical splines are formed with a plurality of teeth 160 which are adapted to interlock with the teeth formed internally of the keyway recesses in the manner explained above. Triangular corner lock 146 has similar horizontal and vertical splines mounted on the inboard side of its triangular plate for locking the opposite sides of the two panel assemblies.

Figure 14:
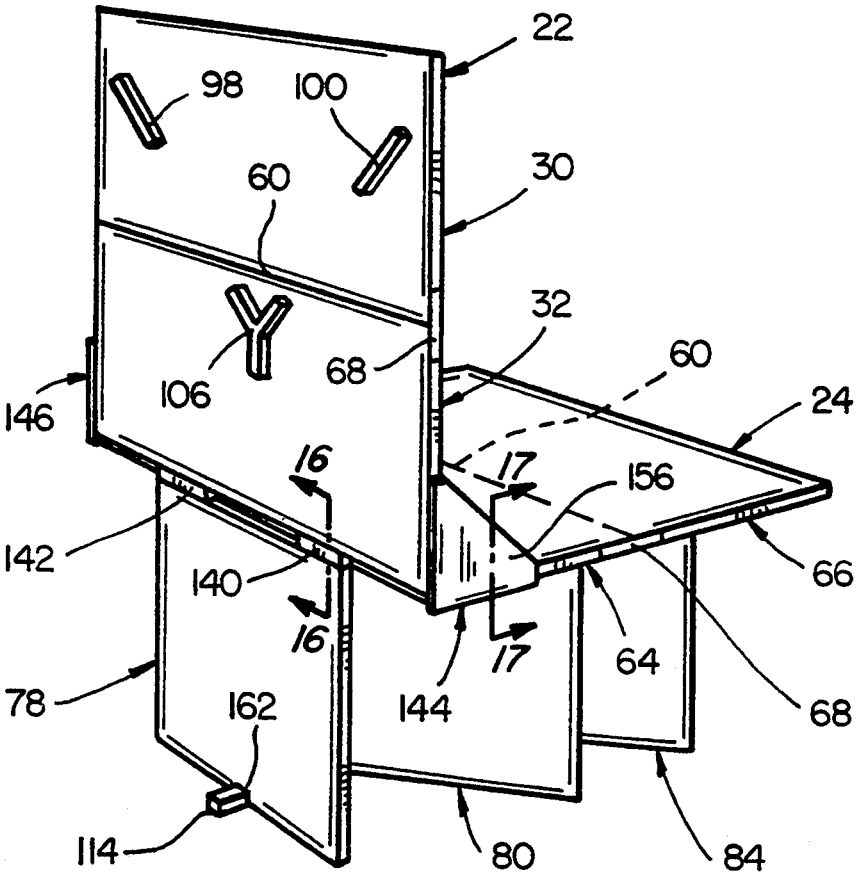
FIG. 14 is a perspective view showing the apparatus of FIG. 1 converted for use in a single player mode.

When converting from the double player configuration to the single player configuration of FIG. 14, the pair of outer leg panels 80 and 82 which otherwise support panel assembly 22 are turned 180° and repositioned beneath the horizontally set panel assembly 24. Center leg panel 78 is also repositioned by being turned 90° into alignment below panel assembly 22, which is set upright. In addition, the "Y" floor support block 114 is repositioned by being turned 180° and moved so that its diverging arms are in alignment below the pair of repositioned end leg panels 80 and 82. The splines of the "Y" block 114 fit within the keyway recesses on the lower perimeter edges of these leg panels to hold the leg panels in place. A notch 162 formed in the lower edge of center leg panel 78 fits over the base leg of "Y" block 114. With panel assembly 22 held upright, it serves as a backstop for the Ping Pong ® balls. In the invention the panel assemblies 22 and 24 are positioned without any space or gap at their joined edges so that balls in play cannot escape between the panel assemblies. This is in contrast to prior art tables which have gaps between the backstops and horizontal playing surfaces.

The use and operation of the invention is as follows. Apparatus 20 is set up in the double player mode by placing center leg panel 78 upright with its lower corners pushed down and locked about the spines which form the base legs of the "Y" floor supports 114 116. The two pairs of end leg panels 80–86 are then set upright with their corners at the converging ends pushed down to lock with the spines which form the diverging arms of the "Y" floor supports 114 and 116. Both tabletop panel assemblies are then unfolded to their open positions with the adjacent edges of subpanels 32 and 64 meeting at the butt joint 112 which forms the net line. The straight blocks 98–104 beneath the outer subpanels are then pushed down into and locked with the keyway recesses in the upper perimeter edges of the end leg panels. At the same time, the "Y" spines 106, 108 beneath the center pair of subpanels are pressed down into and locked with the corresponding upper perimeter edges of the center and end leg panels. Net assembly 28 is then installed. Male spline 128 in the base member of each net post is pushed into and locked with the keyway recesses in the side perimeter edges of the subpanel on either side of butt joint 112. On the opposite side of each folding butt joint 60 for each tabletop panel assembly the "H"-shaped splines 74 are inserted into the cavities 76 formed between the facing keyway recesses, as shown in FIG. 6. The "U"-shaped splines 68 are then pushed into and locked into the keyway recesses of the side perimeter edges on either sides of the folding butt joints. Net 110 is then installed and drawn tight by the strings which are tied around the hooks 138 on the opposite end posts. Table tennis play can then begin. The planar layer 62 which forms the top surface of each subpanel provides mechanical characteristics, including ball bounce, which are comparable to conventional Ping Pong® tables. The top surface across the entire area of each tabletop panel assembly holds its shape without any objectionable undulations or seams above the folding butt joints. It is also to be observed that assembly of apparatus 20 is accomplished without the requirement for hardware such as screws or fasteners. The apparatus is easy, fast and safe to assemble and disassemble.

Figure 15:
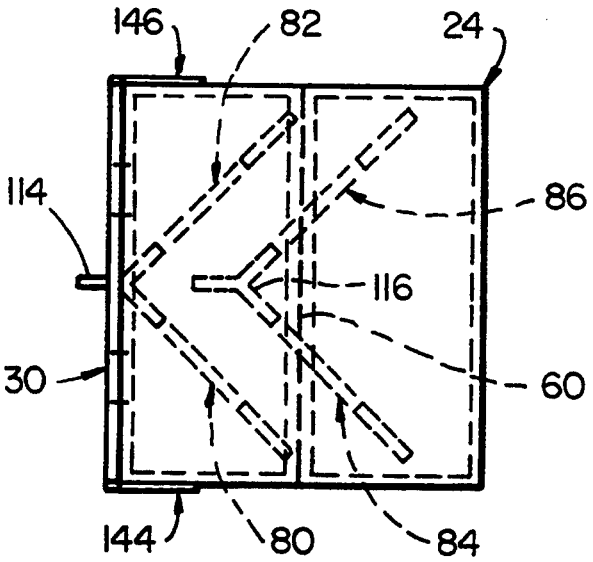
FIG. 15 is a top plan view of the apparatus of FIG. 14.

Apparatus 20 is reconfigured for the single player mode by first removing the net and net posts. One of the tabletop panel assemblies 22 is then disengaged from the underlying end and center leg panels. The "T"-shaped splines 140, 142 are then installed by pushing their center male splines into the keyway recess on the inner side of subpanel 64. After being disengaged, the pair of end leg panels 80, 82 are turned 180° and repositioned beneath panel assembly 24 as shown in FIG. 15. At the same time, "Y" floor support 114 is turned 180° and repositioned beneath and locked with the lower edges of the converging edges of leg panels 80, 82. Center panel 78 is then turned 90° and repositioned so that the keyway recess along its upper perimeter edge locks into lower male spline 150 of "T" spline 140. Panel assembly 22 is then set upright and positioned so that the keyway recess along its lower perimeter edge locks with upper male spline 148. The pair of triangular corner locks 144, 146 are then installed by pushing their "U" splines 158 into the keyway recesses along the perimeter edges of subpanel 64.

Apparatus 20 can be easily and rapidly unfolded and collapsed from either of the single player or double player configurations. For each tabletop panel assembly, the "H"-shaped splines 74 and "U"-shaped splines 68 are unlocked and removed. The subpanels are lifted up to unlock the splines 98 from the keyway recesses in the leg panels. One subpanel of each panel assembly is then pivoted back to the folded position shown in broken line of FIG. 10. The two panel assemblies 22 and 24 are then positioned together with their subpanels interleaving in the manner shown in FIG. 11. The resulting unit is relatively lightweight and is of a size small enough for shipping by parcel delivery service. The end leg panels are then folded together and stacked with center leg panel 78 to form, with the splines, floor supports, net, net posts and triangular corner locks, a second lightweight and compact unit which is also suitable for shipping by parcel delivery service.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A foldable table tennis apparatus comprising:

a set of first and second subpanels, each subpanel being supported by a support structure, said support structure having upper and lower surfaces bounded by a pair of opposite side perimeter edges and a pair of opposite end perimeter edges, said support structure being positioned in juxtaposed relationship along adjacent end perimeter edges to define a butt joint therebetween;

a playing surface comprising a planar layer attached to and extending across a substantial portion of said upper surface of said support structure of each subpanel, said planar layer further providing pivot means for supporting said adjacent end perimeter edges for pivotal movement of said subpanels between open and folded positions, said pivot means being a portion of said planar layer not attached to said upper surfaces of said support structures along a strip extending along said adjacent end perimeter edges defining said butt joint, said end perimeter edges being spaced a width sufficient to receive a third one of said subpanel therebetween when said first and second subpanels are in said folded position; said planar layer being comprised of a material which permit said planar layer to flex along said strip and being of sufficient strength to hold said first and second subpanels in spaced relationship during said pivotal movement about said butt joint, said subpanels, when in said open position, being aligned substantially coplanar whereby said planar layer provides a substantially uniform playing surface, and when "said folded position, are in a substantially face-to-face relationship.

2. The table tennis apparatus as defined in claim 1 further includes lock means for releasably locking the subpanels in their open positions.

3. The table tennis apparatus as defined in claim 2 wherein said lock means includes means defining concaval keyway recesses along said adjacent end perimeter edges of each subpanel, said lock means further including spline means insertable within said keyway recesses for releasably holding said adjacent end perimeter edges together.

4. The table tennis apparatus as defined in claim 3 wherein said keyway recesses cooperate together to form an elongate cavity extending lengthwise of the butt joint when the subpanels are in their open positions, and said spline means comprises an elongate spline member, said spline member being insertable within said elongate cavity for releasably locking the subpanels together.

5. The table tennis apparatus as defined in claim 2 wherein said side perimeter edges which are on common sides of the first and second subpanels cooperate together to form an elongate recess extending orthogonal with the butt joint when the subpanels are in their open positions, said spline means comprises an elongate spline member, said spline member being insertable within said elongate recess for releasably locking the subpanels together.

6. The table tennis apparatus as defined in claim 1 wherein said support structures are each comprised of a rigid core extending parallel below the planar layers of respective subpanels, said core having an upper surface, a planar skin secured to the upper surface of the core, and said planar layer is secured to the skin across the upper surface of each support structure.

7. The table tennis apparatus as defined in claim 6 wherein said core is of a planar material joined together to form a plurality of cells which are combined in a honeycomb matrix, said cells having a long axis oriented substantially perpendicular to the planar layer.

8. The table tennis apparatus as defined in claim 1 wherein said material of the playing surface comprises flexible polyvinylchloride having a thickness of substantially 20 mil.

9. The table tennis apparatus as defined in claim 1 further includes at least one leg panel for supporting said subpanels in substantially horizontal relationship when the subpanels are in said open positions.

10. The table tennis apparatus as defined in claim 9 wherein said leg panel comprised of top and bottom perimeter edges and side perimeter edges, and attachment means for releasably attaching said top perimeter edges of the leg panels to the lower surfaces of the respective support structures.

11. The table tennis apparatus as defined in claim 1 further includes an additional tabletop panel assembly comprised of an additional set of said first and second subpanels each of which is comprised of an additional one of said support structures having said playing surface and opposite side perimeter edges and opposite end perimeter edges, and table locking means for locking said sets of subpanels together in said open positions with facing end perimeter edges of adjacent subpanels extending along a center dividing line and with the planar layers of respective subpanels being oriented in coplanar relationship and cooperating to provide a substantially uniformly flat playing surface.

12. The table tennis apparatus as defined in claim 1 wherein said table locking means comprises means for defining concaval keyway recesses along said facing end perimeter edges which extend along said center dividing line, and spline means insertable within said keyway recesses for releasably holding said facing end perimeter edges together.

13. The table tennis apparatus as defined in claim 11 wherein said table locking means further includes net post means for supporting a net over said center dividing line.

14. The table tennis apparatus as defined in claim 1 for use in a single player mode whereby an additional tabletop panel assembly comprised of an additional set of said first and second subpanels each of which is comprised of an additional one of said support structures having said playing surface means and opposite side perimeter edges and opposite end perimeter edges, and table locking means for locking said first and second sets of subpanels together with said first mentioned set being positioned horizontal and with said additional set being positioned upright and extending upwardly from the tabletop panel assembly of the first mentioned set.

15. The table tennis apparatus as defined in claim 14 wherein said sets of said addition set of subpanels are positioned together along facing end perimeter edges, and said table locking means includes means defining concaval keyway recesses along said facing end perimeter edges, said table locking means further including spline means insertable within said keyway recesses for releasably holding said facing end perimeter edges together.

16. The table tennis apparatus as defined in claim 15 wherein said spline means comprises an elongate spline member having a first male spline and a second male spline, said first male spline being insertable within said concaval keyway recess of the end perimeter edge of said first mentioned set of subpanels and with the second male spline being insertable within said concaval keyway recess of the end perimeter edge of said additional set of subpanels.

17. The table tennis apparatus as defined in claim 14 further include at least one leg panel for support said sets of subpanels in said respective horizontal and upright positions.

18. The table tennis apparatus as defined in claim 17, wherein said at least one leg panel has a top perimeter edge, said table locking means includes means defining a concaval keyway recess along said top perimeter edge of the leg panel and further defining a concaval keyway recess along either of said facing end perimeter edges of the sets of subpanels, and said table locking means further include spline means insertable within said keyway recesses.

19. A foldable table tennis apparatus comprising:

a set of first and second subpanels, each subpanel being supported by a support structure, said support structure having upper and lower surfaces bounded by a pair of opposite side perimeter edges and a pair of opposite end perimeter edges, said support structure being positioned in juxtaposed relationship along adjacent end perimeter edges to define a butt joint therebetween:

a playing surface comprised of a planar layer attached to and extending across said upper surface of each support structure, said planar layer further extending across said adjacent end perimeter edges defining said butt joint, said planar layer being an elastic material which permit said planar layer to flex a sufficient amount to enable said first and second subpanels to pivot about said butt joint between open and folded positions; said subpanels when in said open position being aligned substantially coplanar whereby said planar layer provides a substantially uniform flat playing surface, said subpanels when in said folded position being positioned in substantially face-to-face relationship providing a compact overall configuration; locking means for releasably locking said subpanels in said open position; said locking means being a concaval keyway recesses along said adjacent end perimeter edge of each subpanel and spline means insertable within said keyway recesses for releasably holding said adjacent end perimeter edges together; said locking means further include means defining a first set of teeth in said concaval recesses together with means defining a second set of teeth on said spline means for releasably engaging said first set of teeth.

20. A foldable table tennis table apparatus comprising:

a set of first and second subpanels, each subpanel being supported by a support structure, said support structure, said support structure having upper and lower surfaces bounded by a pair of opposite side perimeter edges and a pair of opposite end perimeter edges; said support structure being positioned in juxtaposed relationship along adjacent end perimeter edges to define a butt joint therebetween; a playing surface comprising a planar layer attached to and extending across said upper surface, said planar layer extending across said adjacent end perimeter edges defining said butt joint; said planar layer being an elastic material which flexes along said butt joint a sufficient amount to enable said first and second subpanels to pivot about said butt joint between open and folded positions; said subpanels when in said open position being aligned substantially coplanar whereby said planar layer is a substantially flat playing surface and when in said folded position being in substantially face-to-face relationship providing a compact overall configuration;

means defining a pair of leg panels for supporting said subpanels in substantially horizontal relationship when said subpanels are in said open position, said leg panels having top and bottom perimeter edges and side perimeter edges; attachment means for releasably attaching said top perimeter edges to said lower surface of said support structure, said attachment means includes means for positioning said leg panels in upright orientation and with said leg panels extending in directions which diverge at an angle from said side perimeter edges.

21. A foldable table tennis apparatus comprising:

a set of first and second subpanels, each subpanel being supported by a support structure, said support structure having upper and lower surfaces bounded by a pair of opposite side perimeter edges and a pair of opposite end perimeter edges, said support structure being positioned in juxtaposed relationship along said end perimeter edges to define a butt joint therebetween;

a playing surface comprising a planar layer attached to end extending across said upper surface of said support structure, said planar layer further extending across said adjacent end across said adjacent end perimeter edges defining said butt joint and being comprised of material which flexes a sufficient amount to enable said first and second subpanels to pivot about said butt joint between open and folded positions; said subpanels when in said open position being aligned substantially coplanar whereby said planar layer provides a substantially uniform flat playing surface and when in said folded position are in a substantially face-to-face relationship to provide a compact overall configuration, support means comprised of at least one leg panel for supporting said subpanels in a substantially horizontal relationship when said panels are in said open position, said leg panel having top and bottom perimeter edges and side perimeter edges and side perimeter edges, attachment means for releasably attaching said top perimeter edge of said leg to said lower surface of said support structure, and means for anchoring said bottom perimeter edge of said leg panel to a floor or other support surface.

* * * * *